US009070254B2

(12) United States Patent
Aoki et al.

(10) Patent No.: US 9,070,254 B2
(45) Date of Patent: Jun. 30, 2015

(54) WAGERING GAME WITH INCREMENTAL UNLOCKING OF CONTENT

(75) Inventors: Dion K. Aoki, Henderson, NV (US); Benjamin T. Gomez, Chicago, IL (US); Jeremy M. Hornik, Chicago, IL (US); Daniel P. Louie, Chicago, IL (US); Jeremie D. Moll, Chicago, IL (US); Jamie W. Vann, Chicago, IL (US)

(73) Assignee: WMS Gaming Inc., Waukegan, IL (US)

( * ) Notice: Subject to any disclaimer, the term of this patent is extended or adjusted under 35 U.S.C. 154(b) by 129 days.

(21) Appl. No.: 13/293,912

(22) Filed: Nov. 10, 2011

(65) Prior Publication Data

US 2012/0122531 A1 May 17, 2012

Related U.S. Application Data

(60) Provisional application No. 61/413,373, filed on Nov. 12, 2010.

(51) Int. Cl.
*G07F 17/32* (2006.01)
*G07F 17/34* (2006.01)

(52) U.S. Cl.
CPC ..... *G07F 17/3258* (2013.01); *G07F 17/3262* (2013.01); *G07F 17/3267* (2013.01); *G07F 17/34* (2013.01)

(58) Field of Classification Search
CPC ..... G07F 17/3258
See application file for complete search history.

(56) References Cited

U.S. PATENT DOCUMENTS

| | | | | |
|---|---|---|---|---|
| 4,342,454 | A | 8/1982 | Baer et al. | 273/85 |
| 4,575,622 | A | 3/1986 | Pellegrini | 235/382 |
| 4,752,068 | A | 6/1988 | Endo | 273/1 E |
| 4,764,666 | A | 8/1988 | Bergeron | 235/380 |
| 4,858,930 | A | 8/1989 | Sato | 273/85 |
| 4,882,473 | A | 11/1989 | Bergeron et al. | 235/380 |
| 4,948,138 | A | 8/1990 | Pease et al. | 273/138 |
| 5,014,982 | A | 5/1991 | Okada et al. | 273/435 |
| 5,018,736 | A | 5/1991 | Pearson et al. | 273/439 |
| 5,179,517 | A | 1/1993 | Sarbin et al. | 364/410 |
| 5,265,874 | A | 11/1993 | Dickinson et al. | 273/138 |
| 5,292,127 | A | 3/1994 | Kelly et al. | 273/138 R |
| 5,321,241 | A | 6/1994 | Craine | 235/380 |
| 5,370,306 | A | 12/1994 | Schulze et al. | 273/138 |
| 5,370,399 | A | 12/1994 | Liverance | 273/434 |

(Continued)

FOREIGN PATENT DOCUMENTS

| | | |
|---|---|---|
| DE | 4200254 | 8/1993 |
| DE | 4236968 | 5/1994 |

(Continued)

*Primary Examiner* — Seng H Lim

(74) *Attorney, Agent, or Firm* — Nixon Peabody LLP

(57) ABSTRACT

A gaming system includes a credit detector adapted to detect a wager to play a wagering game, one or more displays adapted to display, in response to the wager, a base game and a secondary game, the base game providing a trigger that provides an opportunity to play the secondary game, the secondary game including a plurality of decision points, each decision point requiring a selection of one of a plurality of paths and a controller operative to respond to the selection of the path at the one decision point and provide a next decision point for a subsequent selection of another path, a state of the secondary game remaining persistent during repeated plays of the base game so that selected paths in the secondary game are combined to provide non-linear unlocking of a bonus award.

10 Claims, 9 Drawing Sheets

(56) References Cited

U.S. PATENT DOCUMENTS

| | | | | |
|---|---|---|---|---|
| 5,393,057 | A | 2/1995 | Marnell, II | 273/85 |
| 5,429,361 | A | 7/1995 | Raven et al. | 273/138 |
| 5,470,079 | A | 11/1995 | LeStrange et al. | 273/138 |
| 5,533,727 | A | 7/1996 | DeMar | 463/23 |
| 5,547,202 | A | 8/1996 | Tsumura | 463/29 |
| 5,551,692 | A | 9/1996 | Pettit et al. | 273/143 R |
| 5,575,474 | A | 11/1996 | Rossides | 463/26 |
| 5,580,053 | A | 12/1996 | Crouch | 463/20 |
| 5,580,309 | A | 12/1996 | Piechowiak et al. | 463/16 |
| 5,586,766 | A | 12/1996 | Forte et al. | 273/309 |
| 5,586,936 | A | 12/1996 | Bennett et al. | 463/25 |
| 5,609,525 | A | 3/1997 | Ohno et al. | 463/43 |
| 5,655,961 | A | 8/1997 | Acres et al. | 463/27 |
| 5,674,128 | A | 10/1997 | Holch et al. | 463/42 |
| 5,702,304 | A | 12/1997 | Acres et al. | 463/29 |
| 5,741,183 | A | 4/1998 | Acres et al. | 463/42 |
| 5,743,523 | A | 4/1998 | Kelly et al. | 273/138.1 |
| 5,743,800 | A | 4/1998 | Huard et al. | 463/26 |
| 5,752,882 | A | 5/1998 | Acres et al. | 463/42 |
| 5,761,647 | A | 6/1998 | Boushy | 705/10 |
| 5,770,533 | A | 6/1998 | Franchi | 463/42 |
| 5,816,918 | A | 10/1998 | Kelly et al. | 463/16 |
| 5,820,459 | A | 10/1998 | Acres et al. | 463/25 |
| 5,833,537 | A | 11/1998 | Barrie | 463/21 |
| 5,833,540 | A | 11/1998 | Miodunski et al. | 463/42 |
| 5,836,817 | A | 11/1998 | Acres et al. | 463/26 |
| 5,882,258 | A | 3/1999 | Kelly et al. | 463/11 |
| 5,902,983 | A | 5/1999 | Crevelt et al. | 235/380 |
| 5,919,091 | A | 7/1999 | Bell et al. | 463/25 |
| 5,931,467 | A | 8/1999 | Kamille | 273/139 |
| 5,957,775 | A | 9/1999 | Cherry | 463/16 |
| 5,983,196 | A | 11/1999 | Wendkos | 705/14 |
| 5,997,401 | A | 12/1999 | Crawford | 463/20 |
| 6,004,211 | A | 12/1999 | Brenner et al. | 463/40 |
| 6,007,426 | A | 12/1999 | Kelly et al. | 463/16 |
| 6,009,412 | A | 12/1999 | Storey | 705/14 |
| 6,012,045 | A | 1/2000 | Barzilai et al. | 705/37 |
| 6,012,983 | A | 1/2000 | Walker et al. | 463/20 |
| 6,015,344 | A | 1/2000 | Kelly et al. | 463/16 |
| 6,048,269 | A | 4/2000 | Burns et al. | 463/25 |
| 6,061,660 | A | 5/2000 | Eggleston et al. | 705/14 |
| 6,068,552 | A | 5/2000 | Walker et al. | 463/21 |
| 6,068,553 | A | 5/2000 | Parker | 463/27 |
| 6,077,163 | A | 6/2000 | Walker et al. | 463/20 |
| 6,110,041 | A | 8/2000 | Walker et al. | 463/20 |
| 6,113,098 | A | 9/2000 | Adams | 273/143 |
| 6,113,493 | A | 9/2000 | Walker et al. | 463/25 |
| 6,162,122 | A | 12/2000 | Acres et al. | 463/29 |
| 6,165,071 | A | 12/2000 | Weiss | 463/24 |
| 6,178,408 | B1 | 1/2001 | Copple et al. | 705/14 |
| 6,179,710 | B1 | 1/2001 | Sawyer et al. | 463/16 |
| 6,193,608 | B1 | 2/2001 | Walker et al. | 463/25 |
| 6,203,430 | B1 | 3/2001 | Walker et al. | 463/20 |
| 6,227,972 | B1 | 5/2001 | Walker et al. | 463/25 |
| 6,231,445 | B1 | 5/2001 | Acres | 463/42 |
| 6,234,896 | B1 | 5/2001 | Walker et al. | 463/16 |
| 6,244,958 | B1 | 6/2001 | Acres | 463/26 |
| 6,251,014 | B1 | 6/2001 | Stockdale et al. | 463/16 |
| 6,254,481 | B1 | 7/2001 | Jaffe | 463/20 |
| 6,254,483 | B1 | 7/2001 | Acres | 463/26 |
| 6,273,820 | B1 | 8/2001 | Haste, III | 463/40 |
| 6,280,326 | B1 | 8/2001 | Saunders | 463/25 |
| 6,293,866 | B1 | 9/2001 | Walker et al. | 463/20 |
| 6,302,790 | B1 | 10/2001 | Brossard | 463/20 |
| 6,302,793 | B1 | 10/2001 | Fertitta, III et al. | 463/25 |
| 6,311,976 | B1 | 11/2001 | Yoseloff et al. | 273/138 |
| 6,312,334 | B1 | 11/2001 | Yoseloff | 705/14 |
| 6,319,127 | B1 | 11/2001 | Walker et al. | 463/26 |
| 6,334,613 | B1 | 1/2002 | Yoseloff | 463/21 |
| 6,340,331 | B1 | 1/2002 | Saunders et al. | 463/20 |
| 6,364,765 | B1 | 4/2002 | Walker et al. | 273/143 |
| 6,364,766 | B1 | 4/2002 | Anderson et al. | 463/16 |
| 6,365,765 | B1 | 4/2002 | Baldwin et al. | 556/440 |
| 6,371,852 | B1 | 4/2002 | Acres | 463/25 |
| 6,394,900 | B1 | 5/2002 | McGlone et al. | 463/29 |
| 6,394,907 | B1 | 5/2002 | Rowe | 463/24 |
| 6,398,650 | B1 | 6/2002 | Horigami et al. | 705/14 |
| 6,431,983 | B2 | 8/2002 | Acres | 463/25 |
| 6,506,117 | B2 | 1/2003 | DeMar et al. | 463/20 |
| 6,506,118 | B1 | 1/2003 | Baerlocher et al. | 463/25 |
| 6,533,273 | B2 | 3/2003 | Cole et al. | 273/138 |
| 6,540,609 | B1 | 4/2003 | Paige | 463/25 |
| 6,592,456 | B2 | 7/2003 | Walker et al. | 463/20 |
| 6,592,457 | B1 | 7/2003 | Frohm et al. | 463/25 |
| 6,605,001 | B1 | 8/2003 | Tarantino | 705/14 |
| 6,609,975 | B1 | 8/2003 | Sawyer et al. | 463/26 |
| 6,612,575 | B1 | 9/2003 | Cole et al. | 273/138 |
| 6,663,489 | B2 | 12/2003 | Baerlocher | 463/20 |
| 6,682,421 | B1 | 1/2004 | Rowe et al. | 463/25 |
| 6,722,981 | B2 | 4/2004 | Kaminkow et al. | 463/25 |
| 6,722,985 | B2 | 4/2004 | Criss-Puszkiewicz et al. | 463/29 |
| 6,726,562 | B2 * | 4/2004 | Vancura | 463/20 |
| 6,745,236 | B1 | 6/2004 | Hawkins et al. | 709/218 |
| 6,752,312 | B1 | 6/2004 | Chamberlain et al. | 235/375 |
| 6,758,757 | B2 | 7/2004 | Luciano, Jr. et al. | 463/43 |
| 6,761,633 | B2 * | 7/2004 | Riendeau et al. | 463/16 |
| 6,776,713 | B2 | 8/2004 | Gauselmann | 463/16 |
| 6,780,111 | B2 | 8/2004 | Cannon et al. | 463/25 |
| 6,800,027 | B2 | 10/2004 | Giobbi et al. | 463/21 |
| 6,811,486 | B1 | 11/2004 | Luciano, Jr. | 463/24 |
| 6,840,860 | B1 | 1/2005 | Okuniewicz | 463/35 |
| 6,923,721 | B2 | 8/2005 | Luciano et al. | 463/24 |
| 6,986,711 | B2 * | 1/2006 | Vancura | 463/20 |
| 7,182,690 | B2 | 2/2007 | Giobbi et al. | 463/24 |
| 7,682,244 | B1 | 3/2010 | Luciano, Jr. et al. | 463/25 |
| 2001/0024971 | A1 | 9/2001 | Brossard | 463/30 |
| 2001/0046893 | A1 | 11/2001 | Giobbi et al. | 463/24 |
| 2001/0048193 | A1 | 12/2001 | Yoseloff et al. | 273/138.1 |
| 2002/0028708 | A1 | 3/2002 | Busch et al. | 463/42 |
| 2002/0039919 | A1 | 4/2002 | Joshi et al. | 463/20 |
| 2002/0074726 | A1 | 6/2002 | Yoseloff et al. | 273/274 |
| 2002/0077170 | A1 | 6/2002 | Johnson et al. | 463/16 |
| 2002/0077173 | A1 | 6/2002 | Luciano et al. | 463/25 |
| 2002/0077174 | A1 | 6/2002 | Luciano et al. | 463/25 |
| 2002/0082071 | A1 * | 6/2002 | Riendeau et al. | 463/16 |
| 2002/0093136 | A1 | 7/2002 | Moody | 273/139 |
| 2002/0094871 | A1 | 7/2002 | Luciano, Jr. et al. | 463/43 |
| 2002/0107065 | A1 | 8/2002 | Rowe | 463/20 |
| 2002/0151349 | A1 | 10/2002 | Joshi | 463/20 |
| 2002/0196342 | A1 | 12/2002 | Walker et al. | 348/157 |
| 2003/0013515 | A1 | 1/2003 | Rowe et al. | 463/25 |
| 2003/0013531 | A1 | 1/2003 | Rowe et al. | 463/42 |
| 2003/0036422 | A1 | 2/2003 | Baerlocher et al. | 463/20 |
| 2003/0036427 | A1 | 2/2003 | Brandstetter et al. | 463/29 |
| 2003/0064794 | A1 | 4/2003 | Mead et al. | 463/25 |
| 2003/0078101 | A1 | 4/2003 | Schneider et al. | 463/42 |
| 2003/0100362 | A1 | 5/2003 | Horniak et al. | 463/25 |
| 2003/0106769 | A1 | 6/2003 | Weiss | 194/201 |
| 2003/0114219 | A1 | 6/2003 | McClintic | 463/25 |
| 2003/0119579 | A1 | 6/2003 | Walker et al. | 463/20 |
| 2003/0157979 | A1 | 8/2003 | Cannon et al. | 463/16 |
| 2003/0195024 | A1 | 10/2003 | Slattery | 463/9 |
| 2003/0211881 | A1 | 11/2003 | Walker et al. | 463/20 |
| 2004/0053680 | A1 | 3/2004 | Schultz | 463/20 |
| 2004/0142742 | A1 | 7/2004 | Schneider et al. | 463/25 |
| 2004/0180717 | A1 * | 9/2004 | Vancura | 463/20 |
| 2004/0209662 | A1 | 10/2004 | Wadleigh | 463/16 |
| 2004/0254019 | A1 * | 12/2004 | Riendeau et al. | 463/42 |
| 2005/0003886 | A1 | 1/2005 | Englman et al. | 463/25 |
| 2005/0159207 | A1 | 7/2005 | Thomas | 463/20 |
| 2005/0159209 | A1 * | 7/2005 | Fiden et al. | 463/20 |
| 2006/0068893 | A1 | 3/2006 | Jaffe et al. | 463/20 |
| 2006/0079316 | A1 | 4/2006 | Flemming et al. | 463/25 |
| 2006/0079317 | A1 | 4/2006 | Flemming et al. | 463/25 |
| 2006/0084495 | A1 | 4/2006 | Jaffe et al. | 463/20 |
| 2006/0084496 | A1 | 4/2006 | Jaffe et al. | 463/20 |
| 2006/0089194 | A1 | 4/2006 | Joshi et al. | 463/25 |
| 2007/0254734 | A1 | 11/2007 | Gilmore et al. | 463/20 |
| 2007/0259706 | A1 | 11/2007 | Anderson et al. | 463/16 |
| 2007/0259713 | A1 | 11/2007 | Fiden et al. | 463/25 |
| 2007/0265060 | A1 | 11/2007 | Hornik et al. | 463/20 |

(56) References Cited

U.S. PATENT DOCUMENTS

| | | | | |
|---|---|---|---|---|
| 2007/0298856 | A1* | 12/2007 | Gilmore et al. | 463/16 |
| 2008/0113770 | A1 | 5/2008 | Gelber et al. | 463/25 |

FOREIGN PATENT DOCUMENTS

| | | | |
|---|---|---|---|
| EP | 0360613 | 9/1989 | |
| EP | 0431723 | 4/1990 | |
| ES | 2028694 | 7/1992 | |
| GB | 2241098 | 2/1990 | |
| GB | 2332151 | 11/1998 | |
| JP | 60-106680 | 7/1985 | |
| JP | 40-009177 | 1/1992 | |
| JP | 04-079977 | 3/1992 | |
| JP | 05-277233 | 10/1993 | |
| JP | 2265584 | 10/1994 | |
| JP | 07-024128 | 1/1995 | |
| JP | 07-155453 | 6/1995 | |
| JP | 09-276500 | 10/1997 | |
| JP | 10-066777 | 3/1998 | |
| JP | 10-146423 | 6/1998 | |
| JP | 11-309246 | 11/1999 | |
| WO | WO9522811 | 2/1995 | A63F 13/00 |
| WO | WO9712338 | 9/1996 | A63F 13/00 |
| WO | WO9929381 | 12/1998 | A63F 13/00 |
| WO | WO0221467 | 9/2001 | A63F 13/00 |
| WO | WO 2005/082480 | 2/2005 | A63F 13/00 |
| WO | WO 2006/002241 | 6/2005 | A63F 13/00 |
| WO | WO 2006/004831 | 6/2005 | A63F 13/00 |
| WO | WO 2006/004832 | 6/2005 | A63F 13/00 |
| WO | WO 2006/005073 | 6/2005 | |
| WO | WO 2006/017036 | 7/2005 | A63F 13/00 |
| WO | WO 2006/017067 | 7/2005 | A63F 13/00 |
| WO | WO 2006/017068 | 7/2005 | A63F 13/00 |
| WO | WO 2006/020811 | 9/2005 | A63F 13/00 |
| WO | WO 2006/026250 | 9/2005 | |
| WO | WO 2006/044252 | 10/2005 | A63F 9/24 |
| WO | WO 2007/103054 | 2/2007 | G06F 19/00 |
| WO | WO 2008/048634 | 10/2007 | A63F 13/06 |

* cited by examiner

WAGERING GAME WITH INCREMENTAL UNLOCKING OF CONTENT

REFERENCE TO RELATED APPLICATIONS

This application is related to and claims priority to U.S. Provisional Patent Application Ser. No. 61/413,373, filed Nov. 12, 2010, and titled "Wagering Game with Incremental Unlocking of Content," which is incorporated herein by reference in its entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to a gaming apparatus, and methods for playing wagering games, and more particularly, to wagering games in which a player incrementally unlocks a bonus or other content while playing the wagering game.

BACKGROUND OF THE INVENTION

Gaming terminals, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. In some wagering games, the likelihood of winning money is enhanced by providing the player with an opportunity to play a bonus game that may provide an additional winning outcome.

SUMMARY OF THE INVENTION

According to aspects of the present invention, a player incrementally unlocks a bonus or other content while playing a wagering game.

In one example embodiment, a gaming system displays a base game and a secondary game. The base game provides a trigger that provides an opportunity to play the secondary game. The secondary game includes a plurality of decision points, each decision point requiring a selection of one of a plurality of paths. A controller responds to the selection of the path at the one decision point and provides a next decision point for a subsequent selection of another path. A state of the secondary game remains persistent during repeated plays of the base game so that selected paths in the secondary game are combined to provide non-linear unlocking of a bonus award.

In another example embodiment, a gaming system displays a base game and a secondary game. The base game provides a trigger that provides an opportunity to play the secondary game. The secondary game requires an incremental action to be taken, the incremental action producing a variable result. A state of the secondary game remains persistent during repeated plays of the base game so that the secondary game awards a bonus award based on a plurality of incremental actions. A controller responds to the incremental action in the secondary game and determines the variable result for the incremental action.

Additional aspects of the invention will be apparent to those of ordinary skill in the art in view of the detailed description of various embodiments, which is made with reference to the drawings, a brief description of which is provided below.

Figure 1:
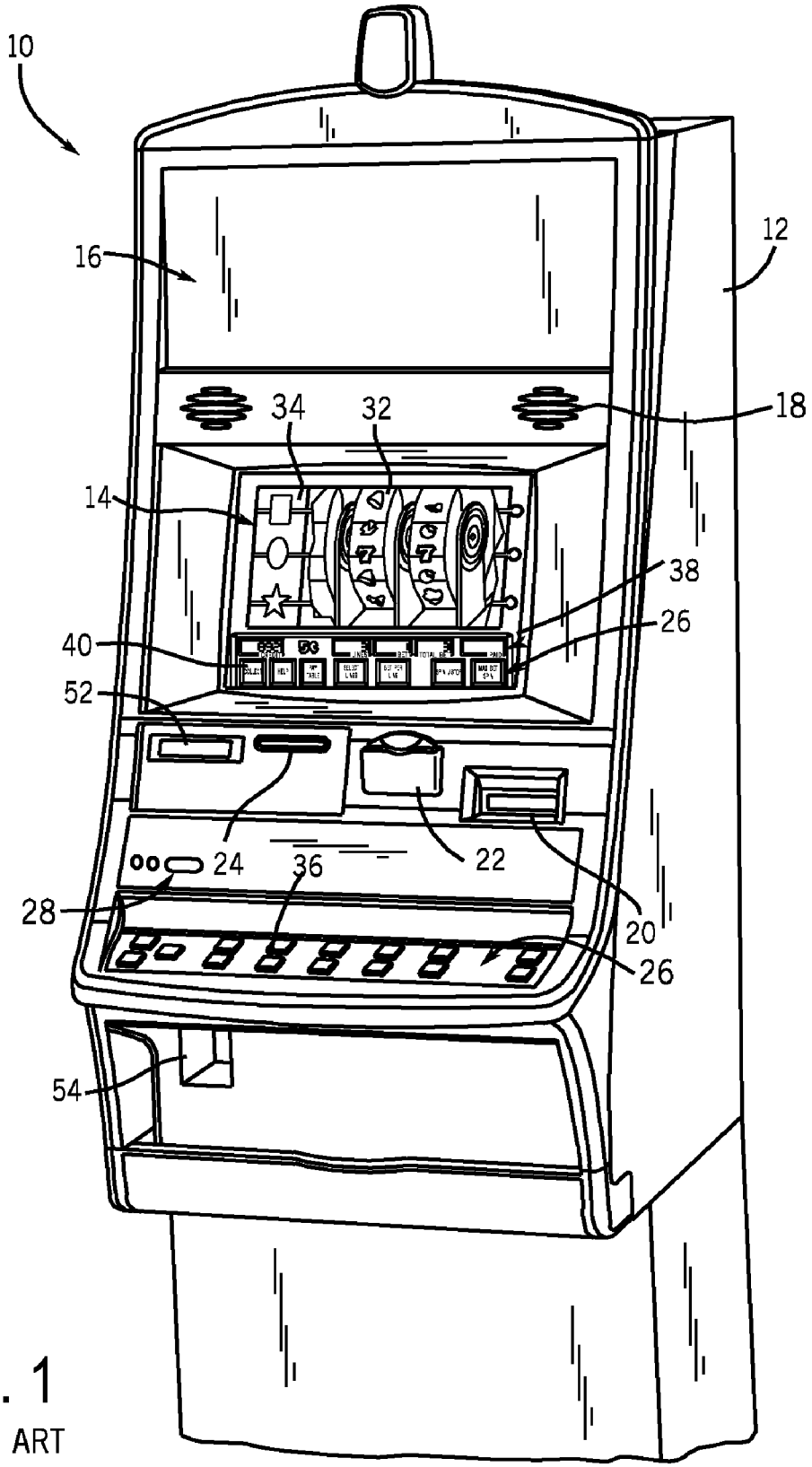
FIG. 1 PRIOR ART
FIG. 1 is a perspective view of a free-standing gaming terminal according to an embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1, there is shown a gaming terminal 10 similar to those used in gaming establishments, such as casinos. With regard to the present invention, the gaming terminal 10 may be any type of gaming terminal and may have varying structures and methods of operation. For example, in some aspects, the gaming terminal 10 is be an electromechanical gaming terminal configured to play mechanical slots, whereas in other aspects, the gaming terminal is an electronic gaming terminal configured to play a video casino game, such as slots, keno, poker, blackjack, roulette, craps, etc. It should be understood that although the gaming terminal 10 is shown as a free-standing terminal of the upright type, the gaming terminal is readily amenable to implementation in a wide variety of other forms such as a free-standing terminal of the slant-top type, a portable or handheld device primarily used for gaming, such as is disclosed by way of example in PCT Patent Application No. PCT/US2007/000792 filed Jan. 11, 2007, titled "Handheld Device for Wagering Games," which is incorporated herein by reference in its entirety, a mobile telecommunications device such as a mobile telephone or personal digital assistant (PDA), a counter-top or bar-top gaming terminal, or other personal electronic device, such as a portable television, MP3 player, entertainment device, etcetera.

The gaming terminal 10 illustrated in FIG. 1 comprises a cabinet or housing 12. For output devices, this embodiment of the gaming terminal 10 includes a primary display area 14, a secondary display area 16, and one or more audio speakers 18. The primary display area 14 and/or secondary display area 16 variously displays information associated with wagering games, non-wagering games, community games, progressives, advertisements, services, premium entertainment, text messaging, emails, alerts or announcements, broadcast information, subscription information, etc. appropriate to the particular mode(s) of operation of the gaming terminal. For input devices, the gaming terminal 10 illustrated in FIG. 1 includes a bill validator 20, a coin acceptor 22, one or more information readers 24, one or more player-input devices 26, and one or more player-accessible ports 28 (e.g., an audio output jack for headphones, a video headset jack, a wireless transmitter/receiver, etc.). While these typical components found in the gaming terminal 10 are described below, it should be understood that numerous other peripheral devices and other elements exist and are readily utilizable in any number of combinations to create various forms of a gaming terminal in accord with the present concepts.

The primary display area 14 include, in various aspects of the present concepts, a mechanical-reel display, a video display, or a combination thereof in which a transmissive video display is disposed in front of the mechanical-reel display to portray a video image in superposition over the mechanical-reel display. Further information concerning the latter construction is disclosed in U.S. Pat. No. 6,517,433 to Loose et al. entitled "Reel Spinning Slot Machine With Superimposed Video Image," which is incorporated herein by reference in its entirety. The video display is, in various embodiments, a cathode ray tube (CRT), a high-resolution liquid crystal display (LCD), a plasma display, a light emitting diode (LED), a DLP projection display, an electroluminescent (EL) panel, or any other type of display suitable for use in the gaming terminal 10, or other form factor, such as is shown by way of example in FIG. 1. The primary display area 14 includes, in relation to many aspects of wagering games conducted on the gaming terminal 10, one or more paylines 30 (see FIG. 3) extending along a portion of the primary display area. In the illustrated embodiment of FIG. 1, the primary display area 14 comprises a plurality of mechanical reels 32 and a video display 34, such as a transmissive display (or a reflected image arrangement in other embodiments), in front of the mechanical reels 32. If the wagering game conducted via the gaming terminal 10 relies upon the video display 34 only and not the mechanical reels 32, the mechanical reels 32 are optionally removed from the interior of the terminal and the video display 34 is advantageously of a non-transmissive type. Similarly, if the wagering game conducted via the gaming terminal 10 relies only upon the mechanical reels 32, but not the video display 34, the video display 34 depicted in FIG. 1 is replaced with a conventional glass panel. Further, in still other embodiments, the video display 34 is disposed to overlay another video display, rather than a mechanical-reel display, such that the primary display area 14 includes layered or superimposed video displays. In yet other embodiments, the mechanical-reel display of the above-noted embodiments is replaced with another mechanical or physical member or members such as, but not limited to, a mechanical wheel (e.g., a roulette game), dice, a pachinko board, or a diorama presenting a three-dimensional model of a game environment.

Video images in the primary display area 14 and/or the secondary display area 16 are rendered in two-dimensional (e.g., using Flash Macromedia™) or three-dimensional graphics (e.g., using Renderware™). In various aspects, the video images are played back (e.g., from a recording stored on the gaming terminal 10), streamed (e.g., from a gaming network), or received as a TV signal (e.g., either broadcast or via cable) and such images can take different forms, such as animated images, computer-generated images, or "real-life" images, either prerecorded (e.g., in the case of marketing/promotional material) or as live footage. The format of the video images can include any format including, but not limited to, an analog format, a standard digital format, or a high-definition (HD) digital format.

The player-input or user-input device(s) 26 include, by way of example, a plurality of buttons 36 on a button panel, as shown in FIG. 1, a mouse, a joy stick, a switch, a microphone, and/or a touch screen 38 mounted over the primary display area 14 and/or the secondary display area 16 and having one or more soft touch keys 40, as is also shown in FIG. 1. In still other aspects, the player-input devices 26 comprise technologies that do not rely upon physical contact between the player and the gaming terminal, such as speech-recognition technology, gesture-sensing technology, eye-tracking technology, etc. The player-input or user-input device(s) 26 thus accept(s) player input(s) and transforms the player input(s) to electronic data signals indicative of a player input or inputs corresponding to an enabled feature for such input(s) at a time of activation (e.g., pressing a "Max Bet" button or soft key to indicate a player's desire to place a maximum wager to play the wagering game). The input(s), once transformed into electronic data signals, are output to a CPU or controller 42 (see FIG. 2) for processing. The electronic data signals are selected from a group consisting essentially of an electrical current, an electrical voltage, an electrical charge, an optical signal, an optical element, a magnetic signal, and a magnetic element.

The information reader 24 (or information reader/writer) is preferably located on the front of the housing 12 and comprises, in at least some forms, a ticket reader, card reader, bar code scanner, wireless transceiver (e.g., RFID, Bluetooth, etc.), biometric reader, or computer-readable-storage-medium interface. As noted, the information reader may comprise a physical and/or electronic writing element to permit writing to a ticket, a card, or computer-readable-storage-medium. The information reader 24 permits information to be transmitted from a portable medium (e.g., ticket, voucher, coupon, casino card, smart card, debit card, credit card, etc.) to the information reader 24 to enable the gaming terminal 10 or associated external system to access an account associated with cashless gaming, to facilitate player tracking or game customization, to retrieve a saved-game state, to store a current-game state, to cause data transfer, and/or to facilitate access to casino services, such as is more fully disclosed, by way of example, in U.S. Patent Publication No. 2003/0045354, published on Mar. 6, 2003, entitled "Portable Data Unit for Communicating With Gaming Machine Over Wireless Link," which is incorporated herein by reference in its entirety. The noted account associated with cashless gaming is, in some aspects of the present concepts, stored at an external system 46 (see FIG. 2) as more fully disclosed in U.S. Pat. No. 6,280,328 to Holch et al. entitled "Cashless Computerized Video Game System and Method," which is incorporated herein by reference in its entirety, or is alternatively stored directly on the portable storage medium. Various security protocols or features can be used to enhance security of the portable storage medium. For example, in some aspects, the individual carrying the portable storage medium is required to enter a secondary independent authenticator (e.g., password, PIN number, biometric, etc.) to access the account stored on the portable storage medium.

Figure 2:
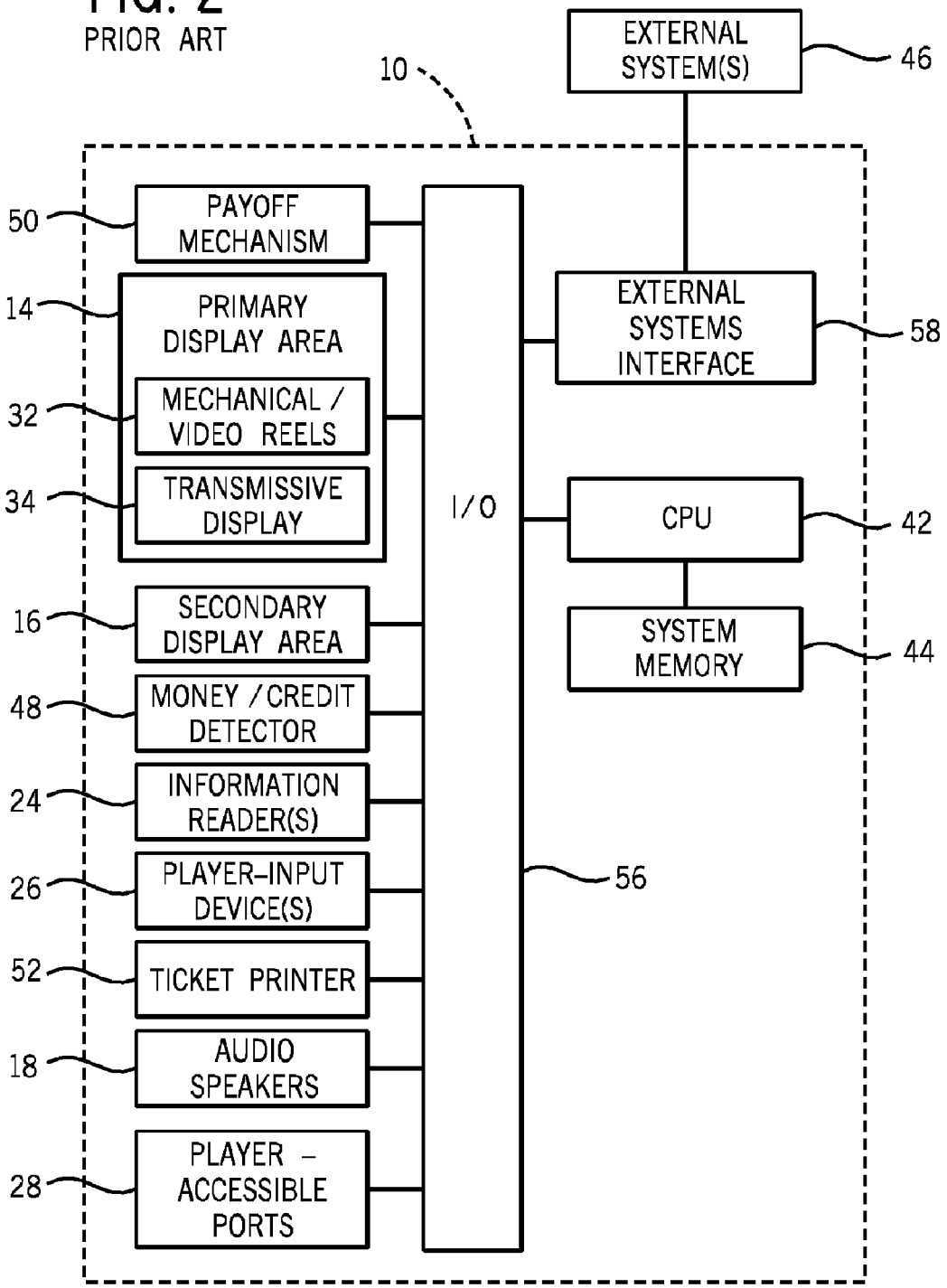
FIG. 2 PRIOR ART
FIG. 2 is a schematic view of a gaming system according to an embodiment of the present invention.

Turning now to FIG. 2, the various components of the gaming terminal 10 are controlled by one or more processors (e.g., CPU, distributed processors, etc.) 42, also referred to herein generally as a controller (e.g., microcontroller, microprocessor, etc.). The controller 42 can include any suitable processor(s), such as an Intel® Pentium processor, Intel® Core 2 Duo processor, AMD Opteron™ processor, or UltraSPARC® processor. By way of example, the controller 42 includes a plurality of microprocessors including a master processor, a slave processor, and a secondary or parallel processor. Controller 42, as used herein, comprises any combination of hardware, software, and/or firmware disposed in and/or disposed outside of the gaming terminal 10 that is configured to communicate with and/or control the transfer of data between the gaming terminal 10 and a bus, another computer, processor, or device and/or a service and/or a network. The controller 42 comprises one or more controllers or processors and such one or more controllers or processors need not be disposed proximal to one another and may be located in different devices and/or in different locations. For example, a first processor is disposed proximate a user interface device (e.g., a push button panel, a touch screen display, etc.) and a second processor is disposed remotely from the first processor, the first and second processors being electrically connected through a network. As another example, the first processor is disposed in a first enclosure (e.g., a gaming machine) and a second processor is disposed in a second enclosure (e.g., a server) separate from the first enclosure, the first and second processors being communicatively connected through a network. The controller 42 is operable to execute all of the various gaming methods and other processes disclosed herein.

To provide gaming functions, the controller 42 executes one or more game programs comprising machine-executable instructions stored in local and/or remote computer-readable data storage media (e.g., memory 44 or other suitable storage device). The term computer-readable data storage media, or "computer-readable medium," as used herein refers to any media/medium that participates in providing instructions to controller 42 for execution. The computer-readable medium comprises, in at least some exemplary forms, non-volatile media (e.g., optical disks, magnetic disks, etc.), volatile media (e.g., dynamic memory, RAM), and transmission media (e.g., coaxial cables, copper wire, fiber optics, radio frequency (RF) data communication, infrared (IR) data communication, etc). Common forms of computer-readable media include, for example, a hard disk, magnetic tape (or other magnetic medium), a 2-D or 3-D optical disc (e.g., a CD-ROM, DVD, etc.), RAM, PROM, EPROM, FLASH-EPROM, any other memory chip or solid state digital data storage device, a carrier wave, or any other medium from which a computer can read. By way of example, a plurality of storage media or devices are provided, a first storage device being disposed proximate the user interface device and a second storage device being disposed remotely from the first storage device, wherein a network is connected intermediate the first one and second one of the storage devices.

Various forms of computer-readable media may be involved in carrying one or more sequences of one or more instructions to controller 42 for execution. By way of example, the instructions may initially be borne on a data storage device of a remote device (e.g., a remote computer, server, or system). The remote device can load the instructions into its dynamic memory and send the instructions over a telephone line or other communication path using a modem or other communication device appropriate to the communication path. A modem or other communication device local to the gaming machine 10 or to an external system 46 associated with the gaming machine can receive the data on the telephone line or conveyed through the communication path (e.g., via external systems interface 58) and output the data to a bus, which transmits the data to the system memory 44 associated with the processor 42, from which system memory the processor retrieves and executes the instructions.

Thus, the controller 42 is able to send and receive data, via carrier signals, through the network(s), network link, and communication interface. The data includes, in various examples, instructions, commands, program code, player data, and game data. As to the game data, in at least some aspects of the present concepts, the controller 42 uses a local random number generator (RNG) to randomly generate a wagering game outcome from a plurality of possible outcomes. Alternatively, the outcome is centrally determined using either an RNG or pooling scheme at a remote controller included, for example, within the external system 46.

As shown in the example of FIG. 2, the controller 42 is coupled to the system memory 44. The system memory 44 is shown to comprise a volatile memory (e.g., a random-access memory (RAM)) and a non-volatile memory (e.g., an EEPROM), but optionally includes multiple RAM and multiple program memories.

As shown in the example of FIG. 2, the controller 42 is also coupled to a money/credit detector 48. The money/credit detector 48 is configured to output a signal the controller 42 that money and/or credits have been input via one or more value-input devices, such as the bill validator 20, coin acceptor 22, or via other sources, such as a cashless gaming account, etc. The value-input device(s) is integrated with the housing 12 of the gaming terminal 10 and is connected to the remainder of the components of the gaming terminal 10, as appropriate, via a wired connection, such as I/O 56, or wireless connection. The money/credit detector 48 detects the input of valid funds into the gaming terminal 10 (e.g., via currency, electronic funds, ticket, card, etc.) via the value-input device(s) and outputs a signal to the controller 42 carrying data regarding the input value of the valid funds. The controller 42 extracts the data from these signals from the money/credit detector 48, analyzes the associated data, and transforms the data corresponding to the input value into an equivalent credit balance that is available to the player for subsequent wagers on the gaming terminal 10, such transforming of the data being effected by software, hardware, and/or firmware configured to associate the input value to an equivalent credit value. Where the input value is already in a credit value form, such as in a cashless gaming account having stored therein a credit value, the wager is simply deducted from the available credit balance.

As seen in FIG. 2, the controller 42 is also connected to, and controls, the primary display area 14, the player-input device(s) 26, and a payoff mechanism 50. The payoff mechanism 50 is operable in response to instructions from the controller 42 to award a payoff to the player in response to certain winning outcomes that occur in the base game, the bonus game(s), or via an external game or event. The payoff is provided in the form of money, credits, redeemable points, advancement within a game, access to special features within a game, services, another exchangeable media, or any combination thereof. Although payoffs may be paid out in coins and/or currency bills, payoffs are alternatively associated with a coded ticket (from a ticket printer 52), a portable storage medium or device (e.g., a card magnetic strip), or are transferred to or transmitted to a designated player account.

The payoff amounts distributed by the payoff mechanism 50 are determined by one or more pay tables stored in the system memory 44.

Communications between the controller 42 and both the peripheral components of the gaming terminal 10 and the external system 46 occur through input/output (I/O) circuit 56, which can include any suitable bus technologies, such as an AGTL+frontside bus and a PCI backside bus. Although the I/O circuit 56 is shown as a single block, it should be appreciated that the I/O circuit 56 alternatively includes a number of different types of I/O circuits. Furthermore, in some embodiments, the components of the gaming terminal 10 can be interconnected according to any suitable interconnection architecture (e.g., directly connected, hypercube, etc.).

The I/O circuit 56 is connected to an external system interface or communication device 58, which is connected to the external system 46. The controller 42 communicates with the external system 46 via the external system interface 58 and a communication path (e.g., serial, parallel, IR, RC, 10bT, near field, etc.). The external system 46 includes, in various aspects, a gaming network, other gaming terminals, a gaming server, a remote controller, communications hardware, or a variety of other interfaced systems or components, in any combination. In yet other aspects, the external system 46 may comprise a player's portable electronic device (e.g., cellular phone, electronic wallet, etc.) and the external system interface 58 is configured to facilitate wireless communication and data transfer between the portable electronic device and the controller 42, such as by a near field communication path operating via magnetic field induction or a frequency-hopping spread spectrum RF signals (e.g., Bluetooth, etc.).

The gaming terminal 10 optionally communicates with external system 46 (in a wired or wireless manner) such that each terminal operates as a "thin client" having relatively less functionality, a "thick client" having relatively more functionality, or with any range of functionality therebetween (e.g., an "intermediate client"). In general, a wagering game includes an RNG for generating a random number, game logic for determining the outcome based on the randomly generated number, and game assets (e.g., art, sound, etc.) for presenting the determined outcome to a player in an audio-visual manner. The RNG, game logic, and game assets are contained within the gaming terminal 10 ("thick client" gaming terminal), the external systems 46 ("thin client" gaming terminal), or are distributed therebetween in any suitable manner ("intermediate client" gaming terminal).

Figure 3:
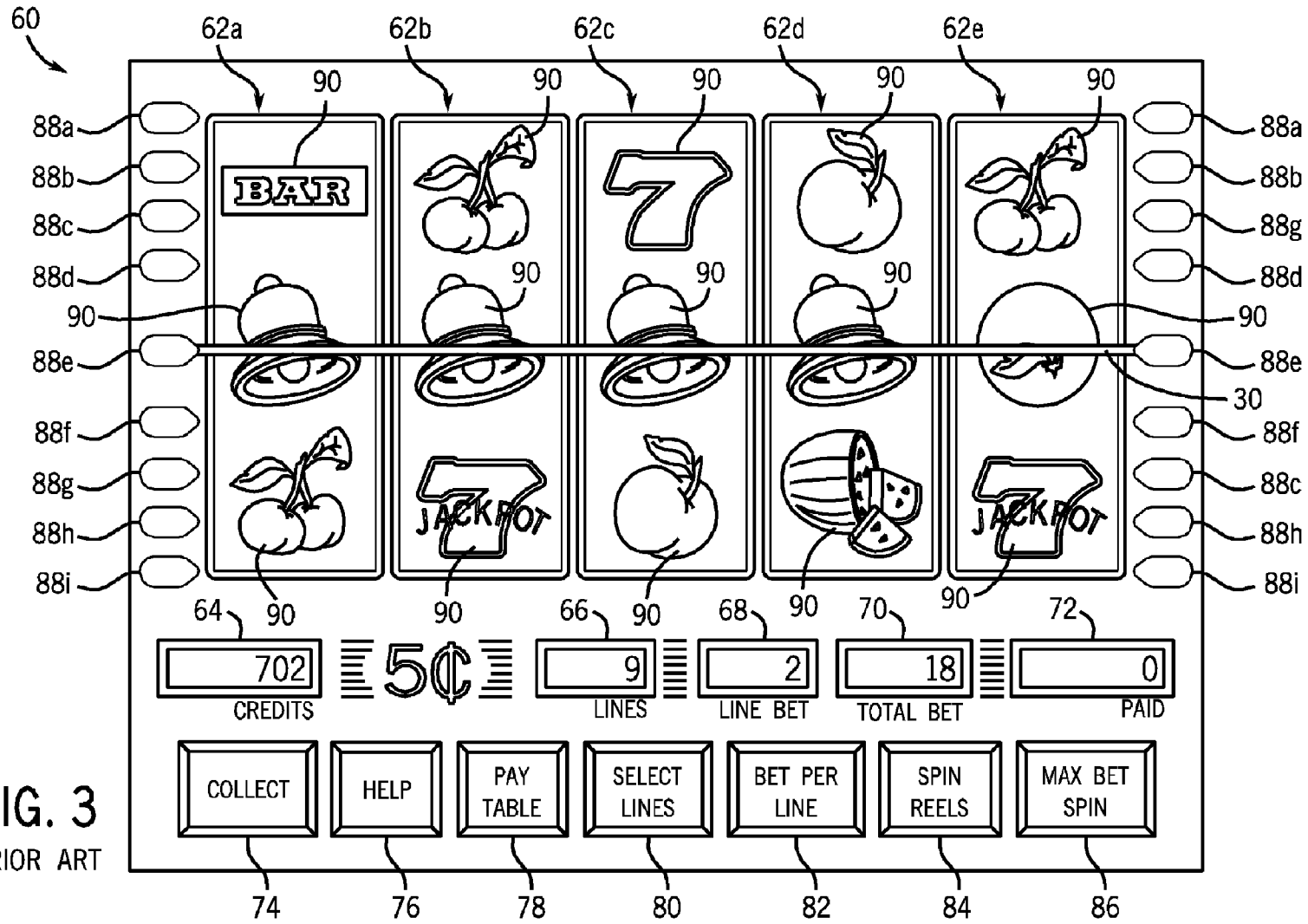
FIG. 3 PRIOR ART
FIG. 3 is an image of an exemplary basic-game screen of a wagering game displayed on a gaming terminal, according to an embodiment of the present invention.

Referring now to FIG. 3, an image of a basic-game screen 60 adapted to be displayed on the primary display area 14 is illustrated, according to one embodiment of the present invention. A player begins play of a basic wagering game by providing a wager. A player can operate or interact with the wagering game using the one or more player-input devices 26. The controller 42, the external system 46, or both, in alternative embodiments, operate(s) to execute a wagering game program causing the primary display area 14 to display the wagering game that includes a plurality of visual elements.

In accord with various methods of conducting a wagering game on a gaming system in accord with the present concepts, the wagering game includes a game sequence in which a player makes a wager, such as through the money/credit detector 48, touch screen 38 soft key, button panel, or the like, and a wagering game outcome is associated with the wager. The wagering game outcome is then revealed to the player in due course following initiation of the wagering game. The method comprises the acts of conducting the wagering game using a gaming apparatus, such as the gaming terminal 10 depicted in FIG. 1, following receipt of an input from the player to initiate the wagering game. The gaming terminal 10 then communicates the wagering game outcome to the player via one or more output devices (e.g., primary display 14) through the display of information such as, but not limited to, text, graphics, text and graphics, static images, moving images, etc., or any combination thereof. In accord with the method of conducting the wagering game, the controller 42, which comprises one or more processors, transforms a physical player input, such as a player's pressing of a "Spin Reels" soft key 84 (see FIG. 3), into an electronic data signal indicative of an instruction relating to the wagering game (e.g., an electronic data signal bearing data on a wager amount).

In the aforementioned method, for each data signal, the controller 42 is configured to processes the electronic data signal, to interpret the data signal (e.g., data signals corresponding to a wager input), and to cause further actions associated with the interpretation of the signal in accord with computer instructions relating to such further actions executed by the controller. As one example, the controller 42 causes the recording of a digital representation of the wager in one or more storage devices (e.g., system memory 44 or a memory associated with an external system 46), the controller, in accord with associated computer instructions, causing the changing of a state of the data storage device from a first state to a second state. This change in state is, for example, effected by changing a magnetization pattern on a magnetically coated surface of a magnetic storage device or changing a magnetic state of a ferromagnetic surface of a magneto-optical disc storage device, a change in state of transistors or capacitors in a volatile or a non-volatile semiconductor memory (e.g., DRAM), etc.). The noted second state of the data storage device comprises storage in the storage device of data representing the electronic data signal from the controller (e.g., the wager in the present example). As another example, the controller 42 further, in accord with the execution of the instructions relating to the wagering game, causes the primary display 14 or other display device and/or other output device (e.g., speakers, lights, communication device, etc.), to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of computer instructions relating to the wagering game is further conducted in accord with a random outcome (e.g., determined by the RNG) that is used by the controller 42 to determine the outcome of the game sequence, using a game logic for determining the outcome based on the randomly generated number. In at least some aspects, the controller 42 is configured to determine an outcome of the game sequence at least partially in response to the random parameter.

The basic-game screen 60 is displayed on the primary display area 14 or a portion thereof. In FIG. 3, the basic-game screen 60 portrays a plurality of simulated movable reels 62*a-e*. Alternatively or additionally, the basic-game screen 60 portrays a plurality of mechanical reels or other video or mechanical presentation consistent with the game format and theme. The basic-game screen 60 also advantageously displays one or more game-session meters and various buttons adapted to be actuated by a player.

In the illustrated embodiment of FIG. 3, the game-session meters include a "credit" meter 64 for displaying a number of credits available for play on the terminal; a "lines" meter 66 for displaying a number of paylines to be played by a player on the terminal; a "line bet" meter 68 for displaying a number of credits wagered (e.g., from 1 to 5 or more credits) for each of the number of paylines played; a "total bet" meter 70 for displaying a total number of credits wagered for the particular round of wagering; and a "paid" meter 72 for displaying an amount to be awarded based on the results of the particular round's wager. The depicted user-selectable buttons include a "collect" button 74 to collect the credits remaining in the credits meter 64; a "help" button 76 for viewing instructions on how to play the wagering game; a "pay table" button 78 for viewing a pay table associated with the basic wagering game; a "select lines" button 80 for changing the number of paylines (displayed in the lines meter 66) a player wishes to play; a "bet per line" button 82 for changing the amount of the wager which is displayed in the line-bet meter 68; a "spin reels" button 84 for moving the reels 62*a-e*; and a "max bet spin" button 86 for wagering a maximum number of credits and moving the reels 62*a-e* of the basic wagering game. While the gaming terminal 10 allows for these types of player inputs, the present invention does not require them and can be used on gaming terminals having more, less, or different player inputs.

As shown in the example of FIG. 3, paylines 30 extend from one of the payline indicators 88*a-i* on the left side of the basic-game screen 60 to a corresponding one of the payline indicators 88*a-i* on the right side of the screen 60. A plurality of symbols 90 is displayed on the plurality of reels 62*a-e* to indicate possible outcomes of the basic wagering game. A winning combination occurs when the displayed symbols 90 correspond to one of the winning symbol combinations listed in a pay table stored in the memory 44 of the terminal 10 or in the external system 46. The symbols 90 may include any appropriate graphical representation or animation, and may further include a "blank" symbol.

Symbol combinations are evaluated in accord with various schemes such as, but not limited to, "line pays" or "scatter pays." Line pays are evaluated left to right, right to left, top to bottom, bottom to top, or any combination thereof by evaluating the number, type, or order of symbols 90 appearing along an activated payline 30. Scatter pays are evaluated without regard to position or paylines and only require that such combination appears anywhere on the reels 62*a-e*. While an embodiment with nine paylines is shown, a wagering game with no paylines, a single payline, or any plurality of paylines will also work with the present invention. Additionally, though an embodiment with five reels is shown in FIG. 3, different embodiments of the gaming terminal 10 comprise a greater or lesser number of reels in accordance with the present invention.

Figure 4:
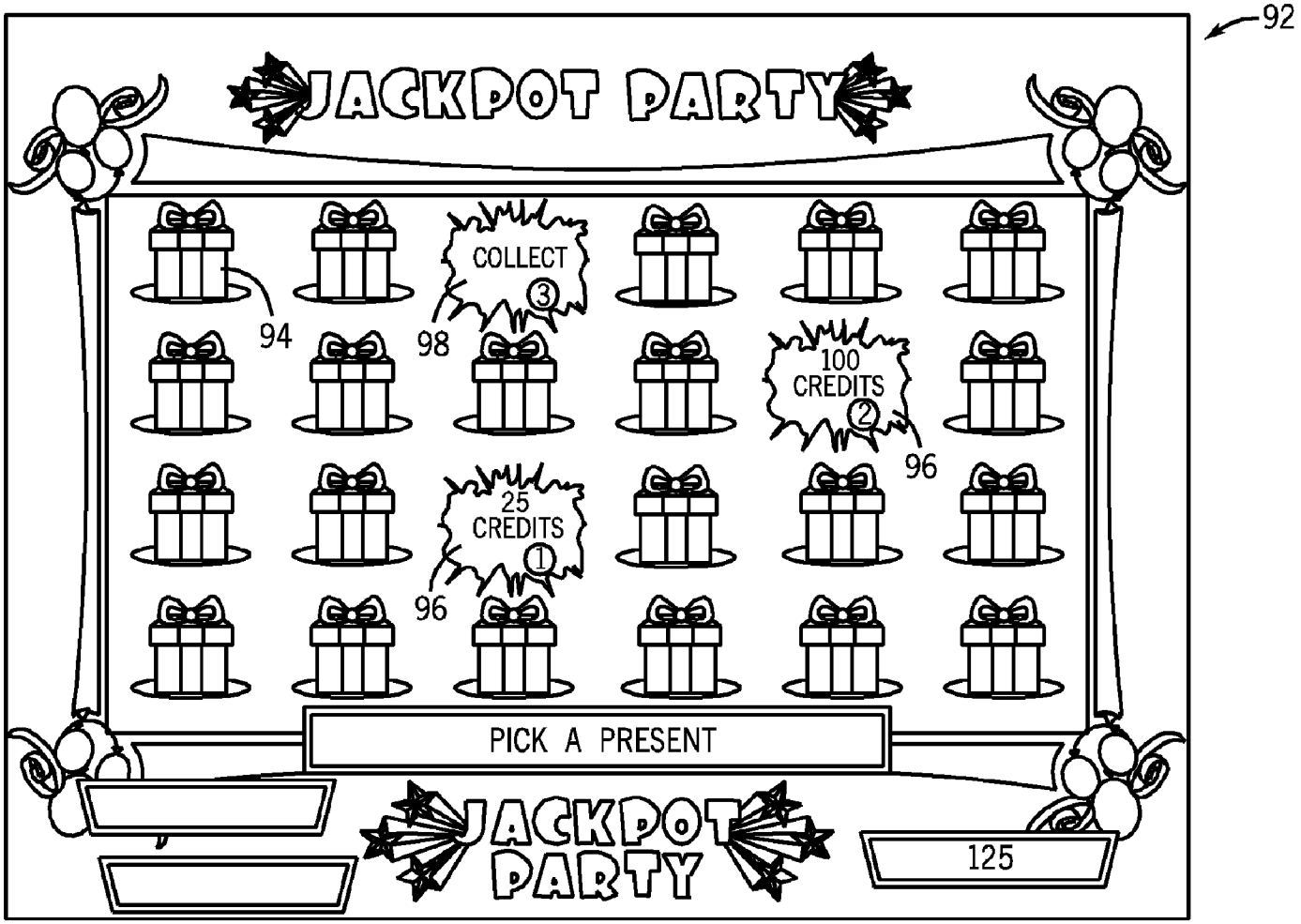
FIG. 4 PRIOR ART
FIG. 4 is an image of a bonus-game screen of an exemplary wagering game displayed on a gaming terminal, according to an embodiment of the present invention.

Turning now to FIG. 4, an example of a bonus game to a basic wagering game is illustrated. A bonus-game screen 92 includes an array of markers 94 located in a plurality of columns and rows. The bonus game is entered upon the occurrence of a triggering event, such as the occurrence of a start-bonus game outcome (e.g., symbol trigger, mystery trigger, time-based trigger, etc.) in or during the basic wagering game. Alternatively, any bonus game described herein is able to be deployed as a stand-alone wagering game independent of a basic wagering game.

In the illustrated bonus game of FIG. 4, a player selects, one at a time, from the array of markers 94 to reveal an associated bonus-game outcome. According to one embodiment of this bonus game, each marker 94 in the array is associated with an award outcome 96 (e.g., credits or other non-negative outcomes) or an end-game outcome 98. In the illustrated example, a player has selected an award outcome 96 with the player's first two selections (25 credits and 100 credits, respectively). When one or more end-game outcome 98 is selected (as illustrated by the player's third pick), the bonus game is terminated and the accumulated award outcomes 96 are provided to the player.

Therefore, as described previously, a player plays the base game illustrated in FIG. 3, and with a single play of the base game, the player may achieve one or more winning combinations of symbols along selected paylines 30. In some embodiments, the base game may also provide the player with an opportunity to play a bonus game to achieve an additional winning outcome. For example, the player may earn the opportunity to play the bonus game shown in FIG. 4 if special bonus symbols appear on the reels 62*a-e* of basic-game screen 60. In such embodiments, however, the opportunity to play the bonus game can be earned during a single play of the base game. As a result, such embodiments do not provide the player a strong incentive to play the wagering game more than once.

To provide the player with an incentive to continue playing a wagering game, embodiments according to the present invention require the player to play the wagering game a plurality of times to unlock a bonus or other content. For example, the player may earn an opportunity to play a bonus game by playing the game a plurality of times. With each play of a base game, the player is permitted to take one of a plurality of actions required to unlock the bonus or other content incrementally.

Figure 5:
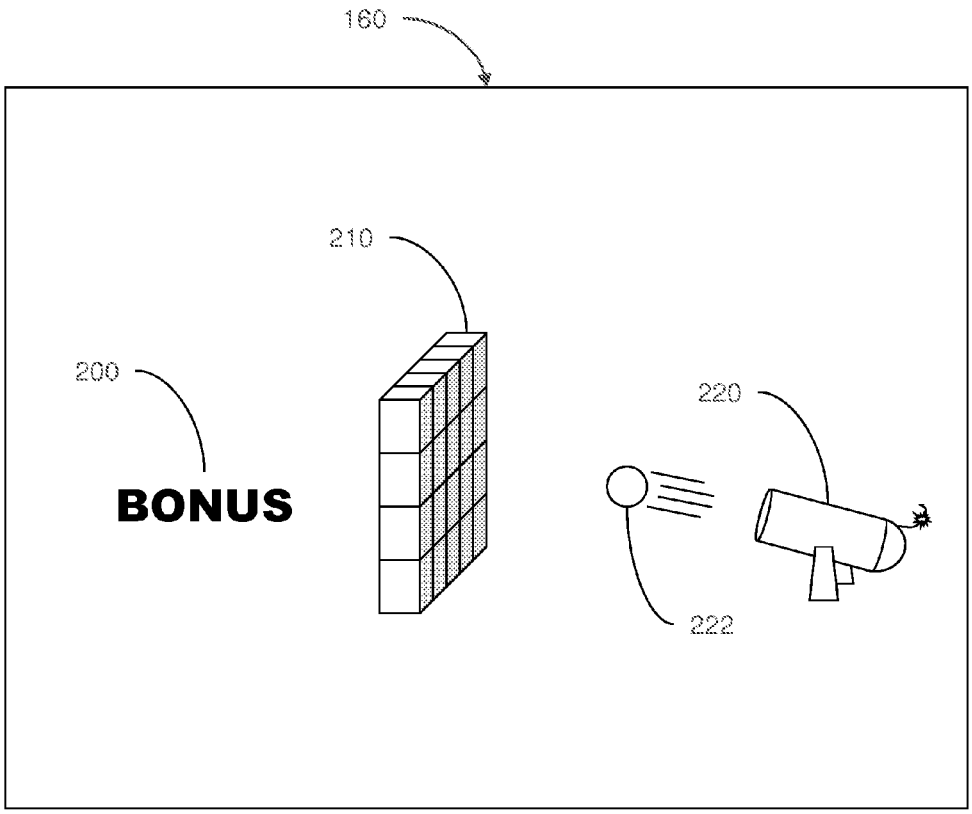
FIGS. 5-9 illustrate example embodiments where a bonus is incrementally unlocked according to aspects of the present invention.

FIG. 5 illustrates an image of a game screen 160 corresponding to a game that requires a player to incrementally unlock a bonus. The game screen 160 is adapted to be displayed on a display area of the gaming terminal 10. In response to a wager and inputs from a player via player-input devices 26, the controller 42 and/or the external system 46 operate to execute a wagering game program that displays the game screen 160.

The game screen 160 is used in combination with a basic-game screen, such as the basic-game screen 60 shown in FIG. 3. Because the basic-game screen is displayed in the primary display area 14, the game screen 160 shown in FIG. 5 may be correspondingly shown in the secondary display area 16.

As shown in FIG. 5, the game screen 160 presents a graphic representation 200 of a bonus. In addition to providing the player with an opportunity to win an award by playing a basic game, the wagering game presents a bonus on the game screen 160 as further incentive to play the wagering game. The bonus, for example, may be an opportunity to play a game, such as the bonus game of FIG. 4. The bonus representation 200 in FIG. 5 is shown as text. However, the bonus representation 200 may be any combination of text and/or graphics that represent the bonus in a visually appealing manner, especially to attract players to the wagering game.

The game screen 160 presents the bonus representation 200 in a scene that fits a particular theme for the wagering game. For example, the theme may correspond with the story of "The Lord of the Rings," and the bonus representation 200 may be shown in a three-dimensional fantasy scene representing Middle-earth.

As FIG. 5 further illustrates, a wall 210 and a cannon 220 are graphically positioned in front of the bonus representation 200. In a theme corresponding to "The Lord of the Rings," the wall may resemble a castle wall. In addition, the cannon 220 is also consistent with the theme. The cannon 220 is aimed at the wall 210 and the bonus representation 200. The cannon 220 fires a cannonball 222 toward the wall 210 and the bonus representation 200. The wall 210 is positioned between the cannon 230 and the bonus representation 200 and provides a "protective" barrier for the bonus representation 200. Accordingly, the cannonball 222 strikes the wall 210, rather than the bonus representation 200.

While playing the base game, the player earns opportunities to fire a cannonball 222 at the wall 210. For example, if the base game employs the basic-game screen 60 of FIG. 3, the player may earn one or more opportunities to fire the cannon 220 if a particular symbol 90 or combination of symbols 90 appears on the reels 62*a-e*. In one embodiment, the appearance of one combination of symbols 90 may provide the player with one shot of the cannon 220, while the appearance of another combination of symbols 90 may provide the player with multiple shots of the cannon 220. In another embodiment, the number of shots of the cannon 220 may be determined by the number of times a particular symbol appears on the reels 62*a-e*.

The base game must be played repeatedly to earn enough opportunities to fire the cannon 220 at the wall 210. Although the state of the base game may be refreshed with each repeated play, the state of the game in game screen 160 remains persistent as a result of each firing of the cannon 220, i.e., damage to the wall 210 is allowed to accumulate over multiple plays of the base game.

Figure 6:
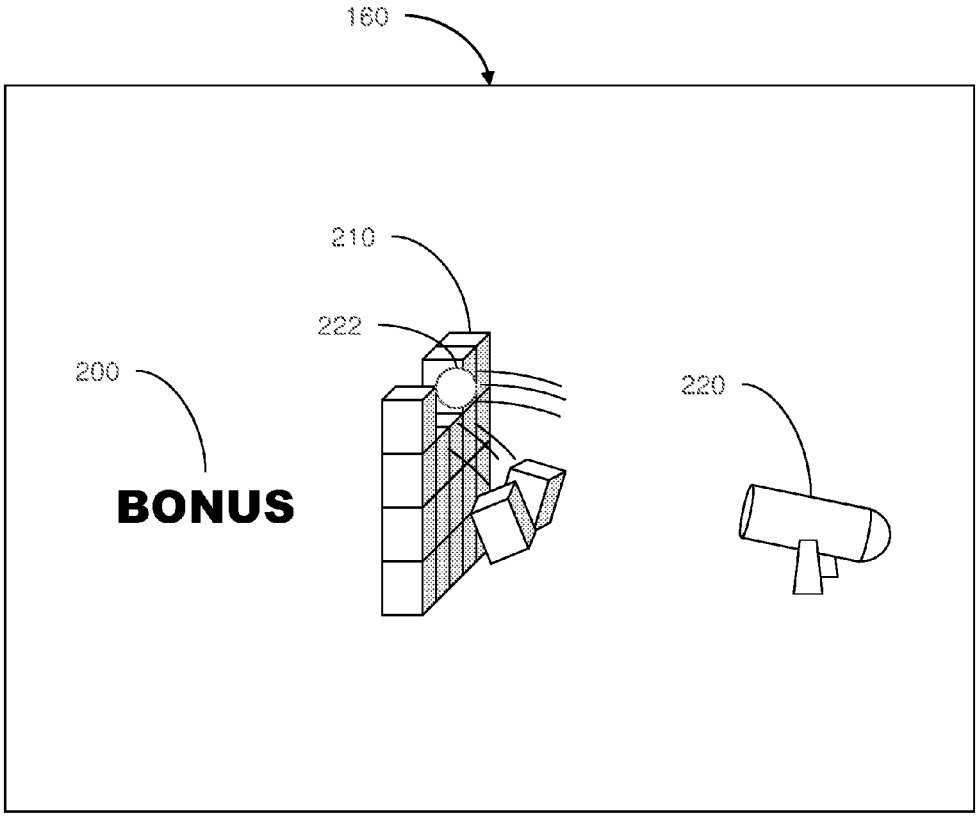

As shown in FIG. 6, after the player fires the cannon 220, the cannonball 222 from the cannon 220 strikes the wall 210 and causes damage to a portion of the wall 210. The portion of the wall 210 struck by the cannonball 222 may be randomly determined by the controller 42 or may depend on the outcome of the base game, e.g., the symbols 90 appearing on the reels 62*a-e* in the basic-game screen 60 in FIG. 3. In an alternative embodiment, the player, via player-input devices 26, may aim the cannon 220 at a selected portion of the wall 210. This alternative embodiment introduces a skill-based component into the game. In general, the player must fire the cannon 220 multiple times to cause complete damage to the wall 210. Each strike incrementally breaks the wall 210.

Graphically, as the wall is damaged by each cannonball 222, a portion of the wall falls or disappears. In some embodiments, the amount of damage to the wall 210 may be constant with each cannonball 222 striking the wall 210. In other embodiments, the amount of damage may be variable and/or random with each cannonball 222 striking the wall 210. Additionally or alternatively, the amount of damage may depend on how the player launches the object at the wall in a skill-based attempt. Additionally or alternatively, the amount of damage may depend on the part of the wall that is hit by the object (e.g., the base of the wall 210 may be damaged less than the top of the wall 210). Additionally or alternatively, the amount of damage may depend on the number of previous strikes, where the amount of damage accelerates with each strike and/or after a certain number of strikes. Additionally or alternatively, the amount of damage may depend on the time of day, where the rate of damage to the wall is increased to encourage players to play during off-peak times for the gaming machine. Additionally or alternatively, the amount of damage may depend on player status, where the rate of damage is greater for a player of higher status. In special cases, the amount of damage may be, with any given shot, sufficient to unlock the bonus.

Figure 7:
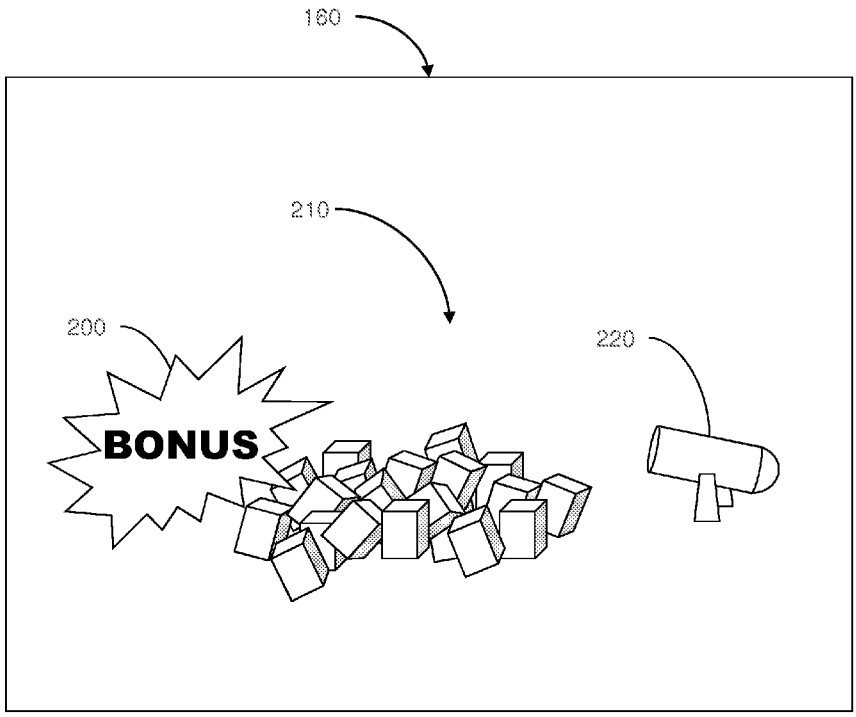

FIG. 7 illustrates the wall 210 after it has been sufficiently destroyed by repeated strikes with cannonballs 222. The player earns the bonus associated with the representation 220 once he or she has fired enough cannonballs 222 at the wall 210 and caused a sufficient amount of damage, e.g., complete destruction. In some embodiments, the number of strikes required to destroy the wall 210 may remain a mystery. Alternatively, the gaming terminal 10 may indicate how many more cannonballs 222 must be fired at the wall to cause it to be sufficiently damaged for awarding the bonus. In further embodiments, the bonus remains a mystery and is revealed only when the player sufficiently destroys the wall 210. Graphically, as the wall is damaged with each object, a portion of the wall falls or disappears to reveal a corresponding portion of the hidden bonus representation 200.

In summary, the player is required to play the basic game repeatedly to earn enough shots of the cannon 220 to destroy the wall 210 and earn the bonus. Accordingly, the game screen 160 provides an approach for incrementally unlocking a bonus.

Figure 8:
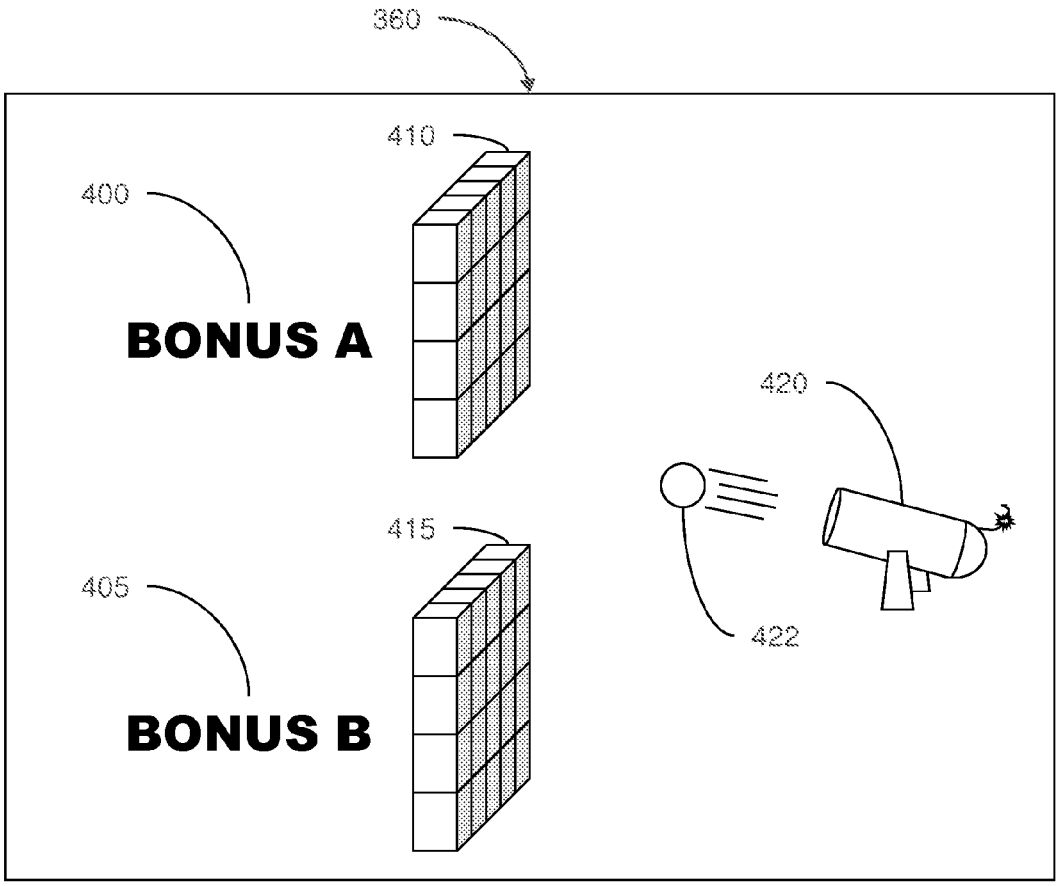

FIG. 8 illustrates a game screen 360 that presents graphic representations of more than one bonus. In particular, a first graphic representation 400 is associated with a bonus A and a second graphic representation 405 is associated with a bonus B. Other embodiments may include additional graphic representations of bonuses. The player may earn the bonus A and/or the bonus B through the game screen 360. In some embodiments, the player is permitted to earn only one of the bonuses A or B. In other embodiments, the player has the option to collect both bonuses A and B.

With the game screen 360, one of the bonuses A or B must be selected to determine whether to fire the cannon 420 at the wall 410 or the wall 415. In some embodiments, the controller 42 may determine the selection, or the selection may depend on the outcome of the basic game, e.g., the symbols 90 appearing on the reels 62*a-e* in the basic-game screen 60 in FIG. 3. Alternatively, the player may select either bonus A or bonus B and fire the cannon 420 at the corresponding wall 410 or 415. Once the player makes the selection, the player may be required to exercise skill in aiming the cannon 420 at a selected portion of the wall 410 or 415, or the controller 42 may determine where the cannonball 422 will strike.

Although the embodiments shown in FIGS. 5-8 illustrate a cannon firing cannonballs at a wall, it is to be understood that other embodiments may present other themes that require the player to take a plurality of actions to gain access to a benefit, such as a bonus. In some embodiments, the wall may be replaced with another type of barrier, such as a door, a force field, etc. In other embodiments, other types of objects, such as rocks, mortar shells, missiles, grenades, bullets, etc., may be directed at the barrier. Moreover, other embodiments allow the player to direct more than one type of object at the wall. The type of object that the player uses may be selected by the controller 42 or the player, or may depend on the outcome of the base game. In addition, the amount of damage to the barrier may be depend on the type of object that strikes the barrier.

Figure 9:
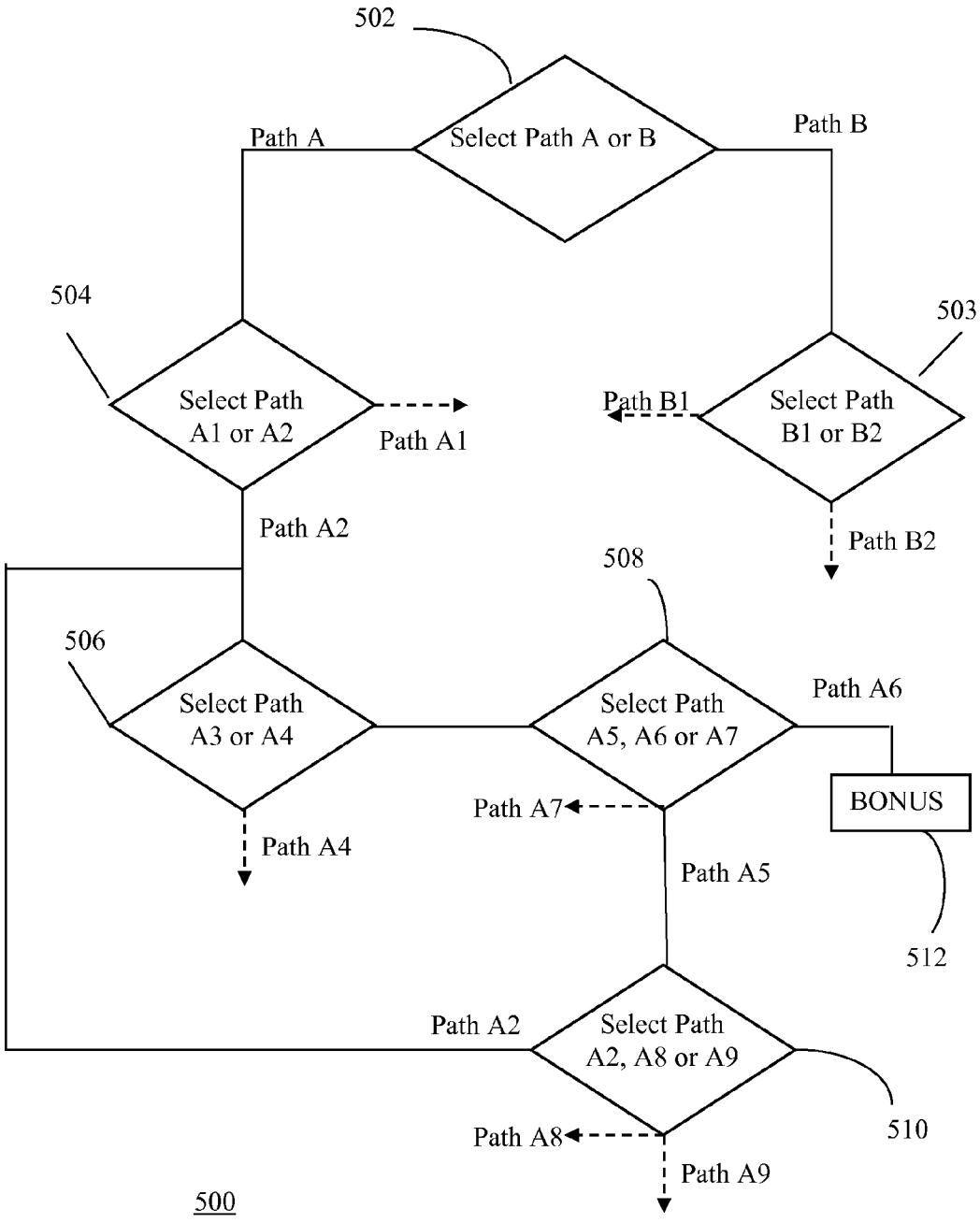

Referring to FIG. 9, another approach for incremental unlocking of a bonus is illustrated. In particular, FIG. 9 illustrates a partial flow chart 500 corresponding to a game that requires a player to select different paths to incrementally unlock a bonus. The game is adapted to be displayed on a display area of the gaming terminal 10. In response to a wager and inputs from a player via player-input devices 26, the controller 42 and/or the external system 46 operate to execute a wagering game program that displays the game. The game is used in combination with a basic-game screen, such as the basic-game screen 60 shown in FIG. 3. Because the basic-game screen is displayed in the primary display area 14, the game may be correspondingly shown in the secondary display area 16.

While playing a base game, a player earns opportunities to select a path from a plurality of paths. The paths are graphically represented on a game screen according to a selected theme for the wagering game. In a game having a theme based on the "Clue" board game, the player may select a room from a plurality of rooms. In a game having a theme based on the story of "Aladdin," the player may select a cave from a plurality of caves. As shown in FIG. 9, a decision point 502 requires the player to select one of two paths A or B. If the player selects path A, the player is required to select path A1 or A2 in the next decision point 504. However if the player selects path B, the player is required to select path B1 or B2 in the next decision point 506. As FIG. 9 shows further, the player is required to make a plurality of choices between different paths in subsequent decision points 506, 508, 510, and so on. The number of options at each step may vary, e.g., two options are shown in steps 502, 503, 504, and 506, while three options are shown in steps 508 and 510. Each path may branch into a plurality of paths. Paths that are available for selection depend on the path(s) previously selected by the player. In addition, as seen in decision step 510, paths, e.g., path A2, may be repeated as options for selection by the player. The plurality of paths may provide a map of varying variety and complexity.

When the player has made a particular combination of choices between paths, he or she earns a bonus. For example, in FIG. 9, the player earns a bonus 512 when he or she selects the paths A, A2, A3, and A6. In some embodiments, several bonuses of different types are provided and each bonus can be earned by selecting one or more combination of paths. However, the number of paths in the combinations may vary. In FIG. 9, the bonus 512 is also provided if the player selects the paths A, A2, A3, A5, A2, A3, and A6. In further embodiments, there are no dead ends and the player can always earn a bonus.

The player earns opportunities to select a new path at a next decision point by playing the base game. For example, if the base game employs the basic-game screen 60 of FIG. 3, the player may earn one or more opportunities to select a path if a particular symbol 90 or combination of symbols 90 appears on the reels 62*a-e*. In one embodiment, the appearance of one combination of symbols 90 may provide the player with an opportunity to select one path at one decision point, while the appearance of another combination of symbols 90 may provide the player with multiple path selections. In another embodiment, the number of opportunities to select a path may be determined by the number of times a particular symbol appears on the reels 62*a-e*.

The base game must be played repeatedly to earn enough opportunities to select enough paths to earn a bonus. Although the state of the base game may be refreshed with each repeated play, the state of the game of FIG. 9 remains persistent so that the path selections over multiple plays of the base game can be combined.

In summary, the player is required to select more than one path to earn a bonus. Accordingly, FIG. 9 provides an example approach for incrementally unlocking a bonus. It is further noted that the resulting paths and combination of paths provide a non-linear approach for incrementally unlocking a bonus.

In general, embodiments of the present invention require a plurality of actions by a player, and each action results in an incremental unlocking of a bonus. As described above, the player is permitted to take an action after achieving an outcome in a base game. Examples of such actions described above include firing a cannon to incrementally damage a wall that keeps a bonus locked or selecting a path to incrementally arrive at a bonus. In another example, a player earns free spins from a base game, and the free spins are used to unlock a bonus incrementally. However, the actions of a player in embodiments are not limited to these examples.

It is contemplated that the player may be required to complete a series or a combination of any type of action to incrementally unlock a bonus.

Some embodiments require the player to play one or more specified types of games. These types of games may be provided:

a. on different gaming machines, e.g., in the same bank;
b. on the same gaming machine in a server based system;
c. on supplemental handheld devices; and/or
d. through an online (Internet) portal/website.

In some embodiments, the types of games employ a different math model.

In further embodiments, the player is required to use player card points to incrementally unlock a bonus. The player card points are earned by different actions, e.g., relating to game play activity.

In other embodiments, the player is required to provide marketing-related information, e.g., name, e-mail address, mailing address, or survey information, to incrementally unlock a bonus.

In yet other embodiments, the player is required to consume casino services, e.g., dine at a restaurant or stay in a room, to incrementally unlock a bonus.

In further embodiments, the player is required to participate in a "scavenger hunt." Collecting each item on the scavenger list incrementally unlocks a bonus.

According to aspects of the present invention, the rate of unlocking may depend on the time of day, where the rate of damage to the wall is increased to encourage players to play during off-peak times. Alternatively or additionally, the rate of unlocking may depend on player status, where the rate of damage is greater for a player of higher status. Alternatively or additionally, the rate of unlocking may depend on other game play statistics, e.g., how long a player has been playing particular game(s), machine(s), etc.

According to aspects of the present invention, the player may play a skill-based event to unlock the bonus/content.

According to aspects of the present invention, something physical may be required to unlock the bonus, such as a player's card, ID, or keychain.

According to aspects of the present invention, one or more players may act together to unlock the bonus/content.

According to aspects of the present invention, a player may trade an opportunity to unlock bonus with another benefit, such as a multiplier.

According to aspects of the present invention, the expected value (EV) may change or remain the same with each unlocking step. In some embodiments, the player moves on to play a game with a more favorable EV, i.e., a higher EV.

Although the embodiments above may describe the incremental unlocking of a bonus. It is understood that embodiments may unlock any type of benefit. In general, embodiments may provide any type of benefit as incentive to play the wagering game. To provide some examples, players may play the wagering game to incrementally unlock:

a. a direct payout;
b. an opportunity to play in a subsequent game, such as the bonus game described above;
c. an opportunity to play a game with a different expected value (EV), i.e., unlock EV;
d. an opportunity to play a game with "power-ups," where volatility is unlocked with multipliers (2×, 3×, 4×, . . . ) and a player can play a game at each multiplier with a given volatility (e.g., volatility goes up with greater multipliers);

e. an opportunity to play bonus spins that provide some other benefit (e.g., in a game with an "Aladdin" theme, bonus spins give the player more "magic" to unlock EV);

f. an opportunity to view special content, such as a teaser with a sneak preview of games to come; or g. a collector's card to earn some other benefit.

Each of these embodiments and obvious variations thereof is contemplated as falling within the spirit and scope of the claimed invention, which is set forth in the following claims.

The invention claimed is:

1. A gaming system comprising:

a credit detector adapted to detect a wager to play a wagering game;

one or more displays adapted to display, in response to the wager, a base game and a secondary game, the base game providing a trigger that provides an opportunity to play the secondary game, the secondary game including a plurality of decision points, each decision point requiring a selection of one of a plurality of paths; and a controller operative to respond to the selection of the path at the one decision point and provide a next decision point for a subsequent selection of another path, a state of the secondary game remaining persistent during repeated plays of the base game so that selected paths in the secondary game are combined to provide non-linear unlocking condition of a bonus award, wherein the bonus award is invariably awarded after selection of a random number of paths.

2. The gaming system of claim 1, wherein the path selected at the one decision point is selected by a player.

3. The gaming system of claim 1, wherein the plurality of paths at each decision point depends on previously selected paths at previous decision points.

4. The gaming system of claim 1, wherein the base game provides a randomly determined outcome, the randomly determined outcome of the base game providing an opportunity to play the secondary game and select a path at one of the decision points.

5. A method of conducting a wagering game for a human player, the wagering game including a game sequence in which the player provides an input and a wagering game outcome is determined, the method comprising the acts of:

receiving, via an input device, a wager to play the wagering game;

displaying, on one or more display devices, a base game and a secondary game, the base game providing a trigger that provides an opportunity to play the secondary game, the secondary game including a plurality of decision points, each decision point requiring a selection of one of a plurality of paths; and using one or more processors to respond to the selection of the path at the one decision point and provide a next decision point for a subsequent selection of another path, a state of the secondary game remaining persistent during repeated plays of the base game so that selected paths in the secondary game are combined to provide non-linear unlocking condition of a bonus award, wherein the bonus award is invariably awarded after selection of a random number of paths.

6. The method of claim 5, wherein the path selected at the one decision point is selected by a player.

7. The method of claim 5, wherein the secondary game provides a plurality of bonus awards, each bonus award being awarded according to one or more corresponding combination of selected paths.

8. A gaming system comprising:

a credit detector adapted to detect a wager to play a wagering game;

one or more displays adapted to display, in response to the wager, a base game and a secondary game, the base game providing a trigger that provides an opportunity to play the secondary game, the secondary game including a plurality of decision points, each decision point requiring a selection of one of a plurality of available options; and a controller operative to respond to the selection of the option at the one decision point and provide a next decision point for a subsequent selection of another option, a state of the secondary game remaining persistent during repeated plays of the base game so that selected options in the secondary game are combined to provide non-linear unlocking condition of a bonus award, wherein the bonus award is invariably awarded after selection of a random number of options.

9. The gaming system of claim 8, wherein the option selected at the one decision point is selected by a player.

10. The gaming system of claim 8, wherein the option selected at the one decision point comprises a selection of a path.

* * * * *